US010394166B2

(12) United States Patent
Yamada

(10) Patent No.: US 10,394,166 B2
(45) Date of Patent: Aug. 27, 2019

(54) IMAGE FORMING APPARATUS HAVING A CLEANING DEVICE FOR A TRANSFER BELT AND A PRE-CLEANING BRUSH

(71) Applicant: KYOCERA Document Solutions Inc., Osaka (JP)

(72) Inventor: Masayuki Yamada, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/991,120

(22) Filed: May 29, 2018

(65) Prior Publication Data

US 2018/0348671 A1 Dec. 6, 2018

(30) Foreign Application Priority Data

May 30, 2017 (JP) ..... 2017-107030

(51) Int. Cl.

| | |
|---|---|
| ***G03G 15/16*** | (2006.01) |
| ***G03G 21/12*** | (2006.01) |
| ***G03G 15/02*** | (2006.01) |
| ***G03G 21/00*** | (2006.01) |

(52) U.S. Cl.

CPC ..... *G03G 15/161* (2013.01); *G03G 15/0283* (2013.01); *G03G 21/0011* (2013.01); *G03G 21/0035* (2013.01); *G03G 21/12* (2013.01); *G03G 2215/1661* (2013.01)

(58) Field of Classification Search

CPC ..... G03G 2221/001; G03G 2221/0015

See application file for complete search history.

(56) References Cited

U.S. PATENT DOCUMENTS

2018/0329338 A1* 11/2018 Okano ..... G03G 15/50

FOREIGN PATENT DOCUMENTS

JP 2008276141 A * 11/2008
JP 2010-122610 6/2010
WO WO-2016059881 A1 * 4/2016 ..... G03G 15/16

OTHER PUBLICATIONS

JP_2008276141_A_T MachineTranslation, Japan, 2008.*
JP_2010122610_A_T MachineTranslation Japan, 2010.*
WO_2016059881_A1_T Machine Translation, 2016.*

* cited by examiner

*Primary Examiner* — Victor Verbitsky
(74) *Attorney, Agent, or Firm* — Wenderoth, Lind & Ponack, L.L.P.

(57) ABSTRACT

An image forming apparatus includes a transfer belt, a cleaning device that sweeps off toner remaining on a transfer surface of the transfer belt by using a rotary brush, electrically adsorbs the toner swept by a recovery roller, and removes the toner, a pre-cleaning brush that slidably contacts with the transfer surface of the transfer belt at an upstream side in a belt rotation direction from the cleaning device, and a support member that supports the pre-cleaning brush. A support wall of the support member is formed with openings that liberate foreign matters such as toner and paper powder deposited onto the pre-cleaning brush.

4 Claims, 14 Drawing Sheets

IMAGE FORMING APPARATUS HAVING A CLEANING DEVICE FOR A TRANSFER BELT AND A PRE-CLEANING BRUSH

CROSS-REFERENCE TO RELATED APPLICATION

This application is based upon and claims the benefit of priority from Japanese Patent Application No. 2017-107030 filed on May 30, 2017, the entire contents of which are incorporated herein by reference.

BACKGROUND

The technology of the present disclosure relates to an image forming apparatus.

In the related art, in an electrophotographic image forming apparatus, for example, image formation is performed by primarily transferring a toner image from a photoreceptor to a transfer surface of an intermediate transfer belt and then secondarily transferring the primarily transferred toner image to a sheet and the like. The image forming apparatus generally includes a cleaning device for removing toner remaining on the transfer surface after the secondary transfer.

The cleaning device has a rotary brush, a recovery roller, and a blade. The rotary brush sweeps off remaining toner on a surface of the intermediate transfer belt. The recovery roller receives a bias having a polarity opposite to that of toner, and electrically adsorbs and recovers the toner swept off by the rotary brush. The blade abuts a surface of the recovery roller and scrapes off the toner. The toner scraped off by the blade is conveyed to a recovery tank by a recovery screw.

In this type of cleaning device, there are cases where a pre-cleaning brush is provided at an upstream side in a belt rotation direction from the cleaning device. The pre-cleaning brush physically scratches toner attached to the intermediate transfer belt, thereby allowing the rotary brush to easily sweep off the toner. Furthermore, the pre-cleaning brush adjusts the polarity of the toner having passed through the brush to a predetermined polarity such that the toner is well electrically adsorbed by the rotary brush. In order to achieve the electrical operation, a bias having a predetermined polarity is applied to the pre-cleaning brush in advance.

SUMMARY

An image forming apparatus according to one aspect of the present disclosure includes a transfer belt, a cleaning device, a pre-cleaning brush, and a support member. The transfer belt is an endless belt that travels while carrying a toner image on a transfer surface thereof. The cleaning device sweeps off toner remaining on the transfer surface of the transfer belt by using a rotary brush, electrically adsorbs the toner swept by a recovery roller, and removes the toner. The pre-cleaning brush slidably contacts with the transfer surface of the transfer belt at an upstream side in a rotation direction of the transfer belt from the cleaning device. The support member supports the pre-cleaning brush from a side opposite to the aforementioned transfer belt side.

The support member has a support wall. The support wall extends over approximately the whole in a width direction of the transfer belt while facing the transfer surface of the transfer belt and supports the pre-cleaning brush. The support wall is formed with openings that liberate foreign matters including toner deposited onto the pre-cleaning brush.

DETAILED DESCRIPTION

Hereinafter, examples of embodiments will be described in detail on the basis of the drawings. It is noted that the technology of the present disclosure is not limited to the following embodiments.

<<Embodiment 1>>

Figure 1:
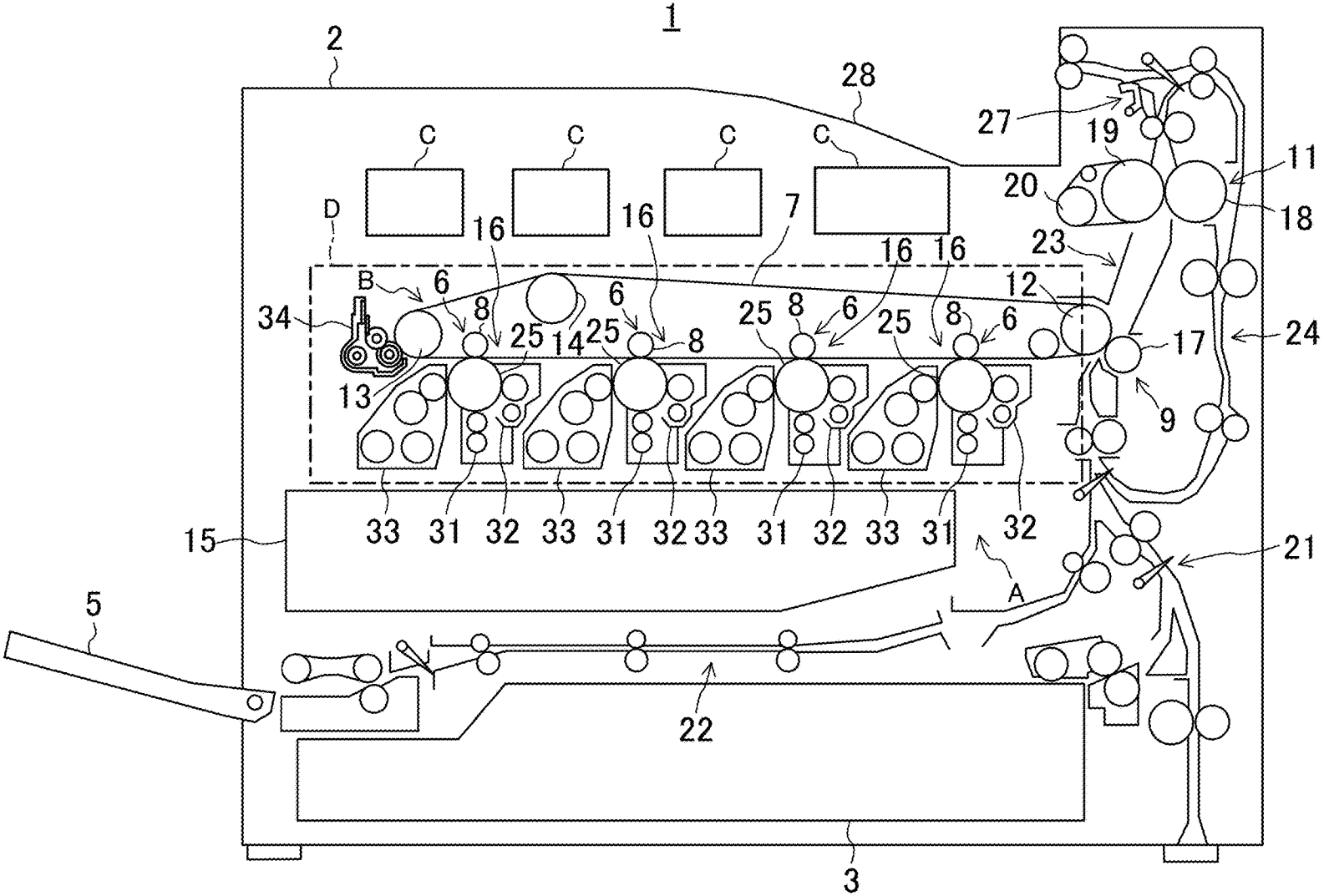
FIG. 1 is an overall schematic diagram illustrating an image forming apparatus in an embodiment.

FIG. 1 is a schematic diagram illustrating an overall configuration of an image forming apparatus 1. The image forming apparatus 1, for example, is a tandem type color printer and includes a development unit A, an intermediate transfer unit B disposed above the development unit A, and a plurality of (four) toner containers C disposed above the intermediate transfer unit B. Furthermore, the image forming apparatus 1 also includes a primary transfer unit 6, a secondary transfer unit 9, a fixing unit 11, and an optical scanning device 15. The development unit A has a plurality of (four) image forming units 16 disposed above the optical scanning device 15. The intermediate transfer unit B has an endless intermediate transfer belt 7, wherein the intermediate transfer belt 7 is disposed above the four image forming units 16 along an arrangement direction of the image forming units 16.

At an internal lower part of a casing 2 of the image forming apparatus 1, a sheet feeding cassette 3 is disposed. The sheet feeding cassette 3 receives non-printed sheets (not illustrated) stacked therein. At a lateral side of the sheet feeding cassette 3, a first sheet conveying unit 21 is provided. The first sheet conveying unit 21 receives the sheets sent from the sheet feeding cassette 3, and conveys the sheets to the secondary transfer unit 9 disposed above.

At a lateral side of the sheet feeding cassette 3, which is opposite to the first sheet conveying unit 21, a manual sheet feeding unit 5 is provided. Between the manual sheet feeding unit 5 and the first sheet conveying unit 21, a second sheet conveying unit 22 is provided. The second sheet conveying unit 22 receives the sheets sent from the manual sheet feeding unit 5, and conveys the sheets to the first sheet conveying unit 21.

The optical scanning device 15 is disposed above the second sheet conveying unit 22, and irradiates laser light to the image forming units 16 on the basis of image data received in the image forming apparatus 1. The intermediate transfer belt 7 is wound around a driving roller 12 and a driven roller 13, and is rotationally driven by a driving device (not illustrated). A reference numeral 14 indicates a tension roller.

The intermediate transfer belt 7 is configured to abut outer peripheral surfaces of a plurality of photosensitive drums 25 and to allow toner images to be transferred from the outer peripheral surfaces of the plurality of photosensitive drums 25. The intermediate transfer belt 7 is an example of an endless transfer belt that travels while carrying a toner image on a transfer surface thereof.

The four image forming units 16 are disposed in a row along the intermediate transfer belt 7, and form yellow, magenta, cyan, and black toner images, respectively. Each of the image forming units 16 has the photosensitive drum 25, and a charging device 31, a developing part 33, and a cleaning device 32, which are disposed around the photosensitive drum 25.

The charging device 31 charges the surface of the photosensitive drum 25. On the photosensitive drum 25 charged by the charging device 31, an electrostatic latent image is formed by the laser light irradiated from the optical scanning device 15. The developing part 33 allows toner supplied from a toner container C to be charged to a predetermined polarity (a plus polarity in the present embodiment), and allows the charged toner to be electrically adsorbed in the electrostatic latent image for development. By so doing, the developing part 33 forms a toner image on the surface of the photosensitive drum 25.

The primary transfer units 6 are disposed above the image forming units 16, respectively. The primary transfer units 6 has a primary transfer roller 8 that primarily transfers the toner image formed on the photosensitive drum 25 by the image forming unit 16 to the surface of the intermediate transfer belt 7.

Together with the rotational driving of the intermediate transfer belt 7, the toner image on each photosensitive drum is transferred to the intermediate transfer belt 7 at a predetermined timing at a voltage having a polarity opposite to a charging polarity of toner applied to the primary transfer roller 8, so that a color toner image, in which toner images of four colors (yellow, magenta, cyan, and black) are superposed on one another, is formed on the surface of the photosensitive drum 25. It is noted that the primary transfer unit 6 applies a voltage having the same polarity as that of toner to the primary transfer roller 8 in an inter-sheet area where image formation is not performed.

The surface of the photosensitive drum 25, from which the toner image has been transferred to the intermediate transfer belt 7, is cleaned by the cleaning device 32.

The secondary transfer unit 9 has a secondary transfer roller 17 disposed at a lateral side of the intermediate transfer belt 7. The secondary transfer unit 9 is configured to transfer the toner images on the intermediate transfer belt 7 to the sheet sent from the first sheet conveying unit 21 at a voltage having a polarity opposite to a charging polarity of toner applied to the secondary transfer roller 17. It is noted that the secondary transfer unit 9 applies a voltage having the same polarity as that of toner to the secondary transfer roller 17 in an inter-sheet area where image formation is not performed.

Figure 2:
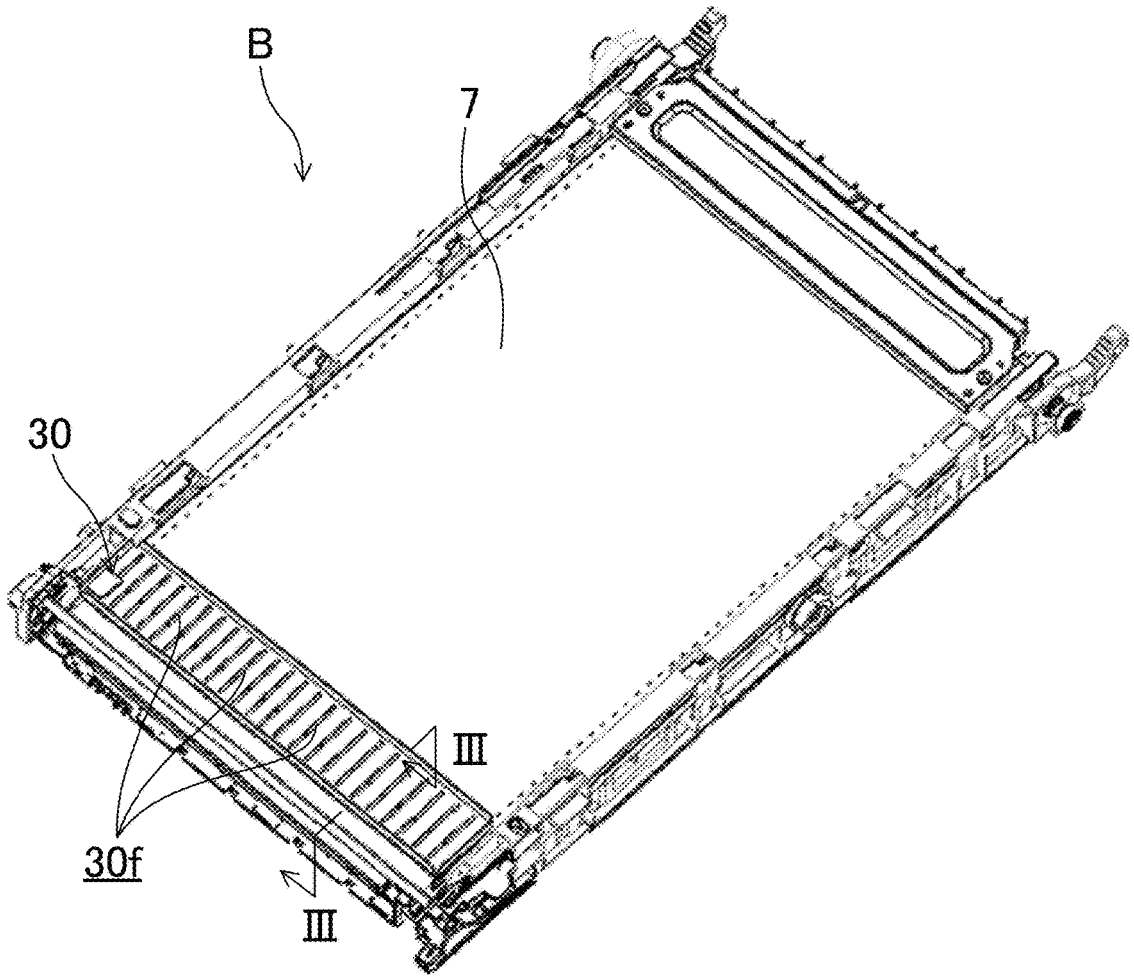
FIG. 2 is a perspective view illustrating an intermediate transfer unit.

At a side of the intermediate transfer belt 7, which is opposite to the secondary transfer unit 9, a cleaning device is disposed to clean the surface of the intermediate transfer belt 7 (see FIG. 2). Details of the cleaning device 34 will be described later.

The fixing unit 11 is provided above the secondary transfer unit 9. Between the secondary transfer unit 9 and the fixing unit 11, a third sheet conveying unit 23 is formed to convey the sheet with the secondarily transferred toner images to the fixing unit 11. The fixing unit 11 includes a pressure roller 18, a fixing roller 19, and a heating roller 20. Furthermore, the fixing unit 11 is configured to heat and press the sheet conveyed from the third sheet conveying unit 23, thereby fixing the toner images to the sheet.

A branch part 27 is provided above the fixing unit 11. The sheet discharged from the fixing unit 11 is discharged from the branch part 27 to a sheet discharge unit 28 formed at an upper part of the image forming apparatus 1 when duplex printing is not performed. When the duplex printing is performed, the sheet is conveyed again from the branch part 27 to the secondary transfer unit 9 via a fourth sheet conveying unit 24.

At a front surface side of the intermediate transfer unit B, an inner unit D is disposed to cover the front surface of the intermediate transfer unit B (see a dashed line), and toner is supplied from the inner unit D to the developing part 33 of the developing unit A via the inner unit D.

Figure 3A:
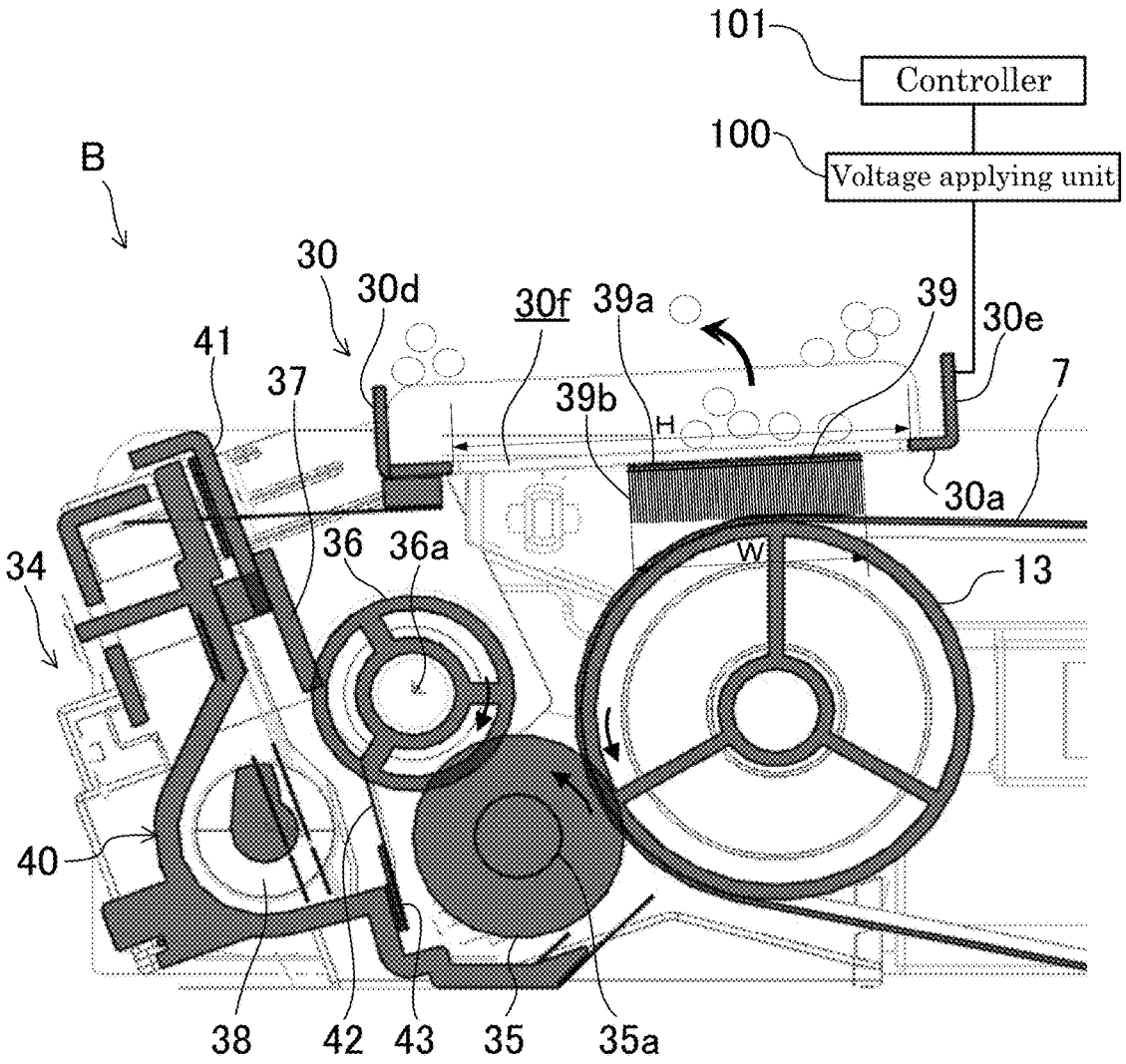
FIG. 3A is a sectional view taken along line III-III of FIG. 2.

Next, details of the cleaning device 34 will be described with reference to FIG. 3A. The cleaning device 34 includes a rotary brush 35, a recovery roller 36, and a blade 37. The rotary brush 35 is a fur brush disposed to face the driven roller 13 while interposing the intermediate transfer belt 7 therebetween. The rotary brush 35 has a rotating shaft 35*a* made of stainless steel (SUS) and a plurality brush fibers raised from an outer peripheral surface of the rotating shaft 35*a*. The rotary brush 35 contacts with the intermediate transfer belt 7 while rotating in a direction opposite to that of the intermediate transfer belt 7, and sweeps off remaining toner attached to the surface of the intermediate transfer belt 7.

The recovery roller 36 having a rotating shaft 36*a* is disposed to abut the rotary brush 35. The recovery roller 36 is configured by stainless steel (SUS) or by allowing the stainless steel (SUS) to have a resistive layer of alumite, nylon rubber and the like. The recovery roller 36 receives a voltage having a polarity opposite to that of toner from a voltage applying unit (not illustrated). The recovery roller 36 collects (removes) the toner swept off by the rotary brush from the intermediate transfer belt 7 by electrically adsorbing the toner. The blade 37 includes a plate-like member which is made of rubber, wherein a distal end part of the blade 37 abuts a surface of the recovery roller 36. The blade 37 scrapes off toner adsorbed to the surface of the recovery roller 36.

Below the blade 37, a discharge screw 38 is disposed to convey the scraped toner to a waste toner bottle (not illustrated). The discharge screw 38 is received in a recovery casing 40.

The recovery casing 40 covers the discharge screw 38 from an opposite side of the recovery roller 36 side. A L-shaped bracket 41 is fixed to an upper end part of the recovery casing 40, and the aforementioned blade 37 is fixed to the L-shaped bracket 41. The blade 37 is downwardly inclined toward the right side of FIG. 3A. The blade 37 abuts a peripheral surface of the recovery roller 36 at a downstream side in the roller rotation direction from a contact part of the rotary brush 35 and the recovery roller 36.

A seal material 42 is fixed to a lower end part of the recovery casing 40 via a board 43. The seal material 42 is upwardly inclined toward the left side of FIG. 3A. The seal material 42 is positioned between the contact part of the rotary brush 35 and the recovery roller 36 and the blade 37 and contacts with a surface of the recovery roller 36. The seal material 42 has a function of preventing the toner scraped off by the blade 37 from flowing back to the intermediate transfer belt 7 side (the right side of FIG. 3A) and a function of intercepting foreign matters such as paper powder attached to the recovery roller 36. By the former backflow preventing function, toner is prevented from being attached to the intermediate transfer belt 7 again and causing transfer failure. Furthermore, by the latter foreign matter intercepting function, foreign matters between the blade 37 and the recovery roller 36 are prevented from being caught and causing breakage of the blade 37.

At an upstream side in the rotation direction of the intermediate transfer belt 7 from the cleaning device 34, a pre-cleaning brush 39 is provided to slidably contact with the transfer surface of the intermediate transfer belt 7. The pre-cleaning brush 39 physically scratches toner attached to the intermediate transfer belt 7, thereby allowing the toner to be easily swept off by the rotary brush 35. Furthermore, the pre-cleaning brush 39 adjusts a polarity of toner having passed through the brush 39 to a predetermined polarity such that the toner is well electrically adsorbed by the recovery roller 36.

Figure 3B:
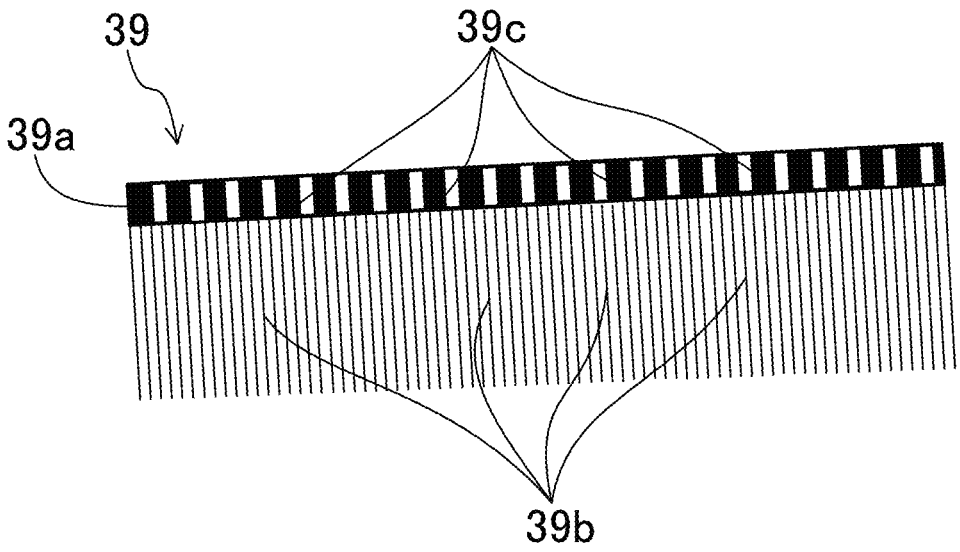
FIG. 3B is an enlarged side view of a pre-cleaning brush.

Specifically, the pre-cleaning brush 39 includes a bar brush extending over the whole in the width direction of the intermediate transfer belt 7. As illustrated in the enlarged view of FIG. 3B, the pre-cleaning brush 39 includes a rectangular plate-like base 39*a* extending in the width direction of the intermediate transfer belt 7, and a plurality of brush fibers 39*b* implanted over the whole of the base 39*a*. The base 39*a* and the brush fibers 39*b* are configured with a conductive member, respectively. The base 39*a* is formed with a plurality of through holes 39*c* having passed through in a thickness direction. In FIG. 3B, the through holes 39*c* are drawn larger than the real size; however, an actual hole diameter of the through hole 39*c* is set to be equal to or to be slightly larger than a maximum diameter of a foreign matter (paper powder) assumed to be deposited onto each of the brush fibers 39*b*. A distal end of each of the brush fibers 39*b* of the pre-cleaning brush 39 abuts the surface of the intermediate transfer belt 7. The pre-cleaning brush 39 is supported by a support member 30. The support member 30 is connected to a voltage applying unit 100. The voltage applying unit 100 applies a voltage having a predetermined polarity to the pre-cleaning brush 39 via the support member 30.

Figure 4:
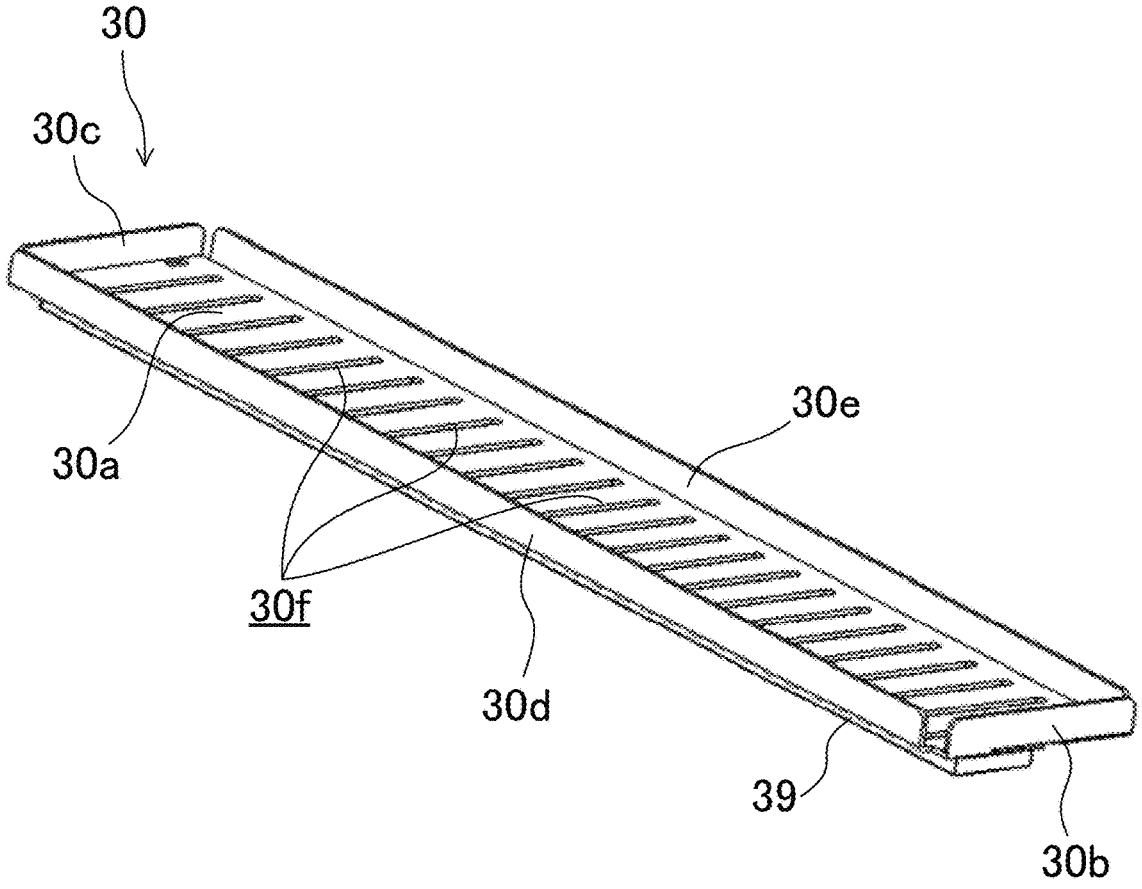
FIG. 4 is a perspective view illustrating a support member of a pre-cleaning brush.

As illustrated in FIG. 4, the support member 30 has a rectangular case shape opened upward. The support member 30 is formed by bending one sheet metal material. The support member 30 extends over approximately the whole in the width direction of the intermediate transfer belt 7 while facing the transfer surface of the intermediate transfer belt 7. Specifically, the support member 30 has a rectangular plate-like support wall 30*a* extending in the width direction of the intermediate transfer belt 7, and a front sidewall 30*b*, a rear sidewall 30*c*, a left sidewall 30*d*, and a right sidewall 30*e* which are upright from four sides of the support wall 30*a*. The pre-cleaning brush 39 is adhered to and fixed to a lower surface of the support wall 30*a*.

Figure 5:
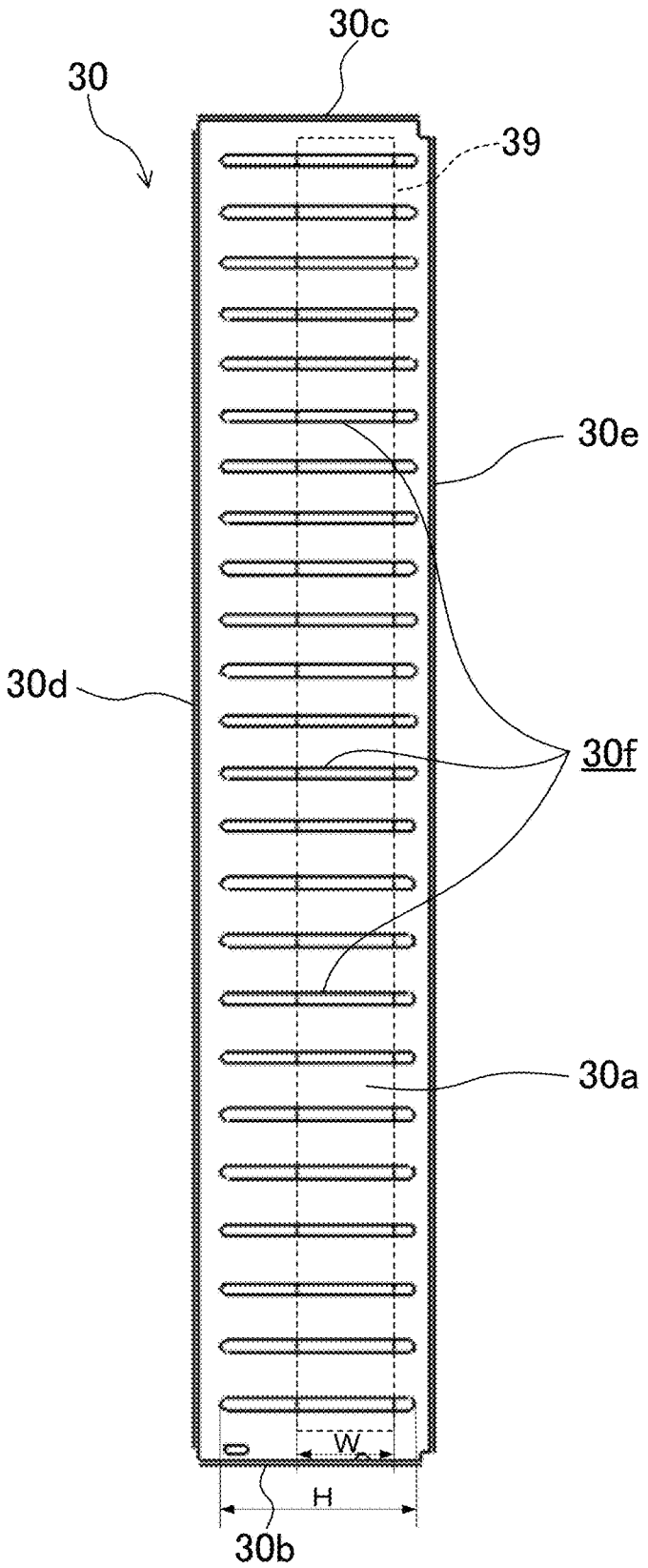
FIG. 5 is a plan view illustrating a support member of a pre-cleaning brush.

As illustrated in FIG. 5, the support wall 30*a* is formed with a plurality of openings 30*f* arranged at equal intervals in a longitudinal direction. The openings 30*f* allow foreign matters such as toner and paper powder deposited onto the pre-cleaning brush 39 to be liberated upward (to an opposite side of the intermediate transfer belt 7 side) as will be described later. In the drawing, "0" schematically indicates the foreign matters and is drawn larger than the real foreign matters such that the drawing is easily seen. Each of the openings 30*f* has a long hole shape extending along the rotation direction of the intermediate transfer belt 7. The pre-cleaning brush 39 is positioned closer to the right end of each of the openings 30*f* when viewed from an upper side of the support wall 30*a*. A width W of the pre-cleaning brush 39 is smaller than a length H of each opening 30*f*.

The aforementioned voltage applying unit 100 is connected to a controller 101 (see FIG. 3A) serving as a control unit. The controller 101 includes a microcomputer having a CPU, a ROM, and a RAM. The controller 101 controls a voltage polarity of a voltage to be applied to the support member 30 (which is a voltage to be applied to the pre-cleaning brush 39) from the voltage applying unit 100. In the present embodiment, the controller 101 controls the voltage applying unit such that the voltage to be applied to the pre-cleaning brush 39 has a polarity equal to a charging polarity of toner. In this way, a polarity of foreign matters such as remaining toner and paper powder having passed through the pre-cleaning brush 39 is adjusted to a plus polarity, so that it is possible to improve recovery efficiency of foreign matters by the recovery roller 36 of the cleaning device 34.

Figure 11:
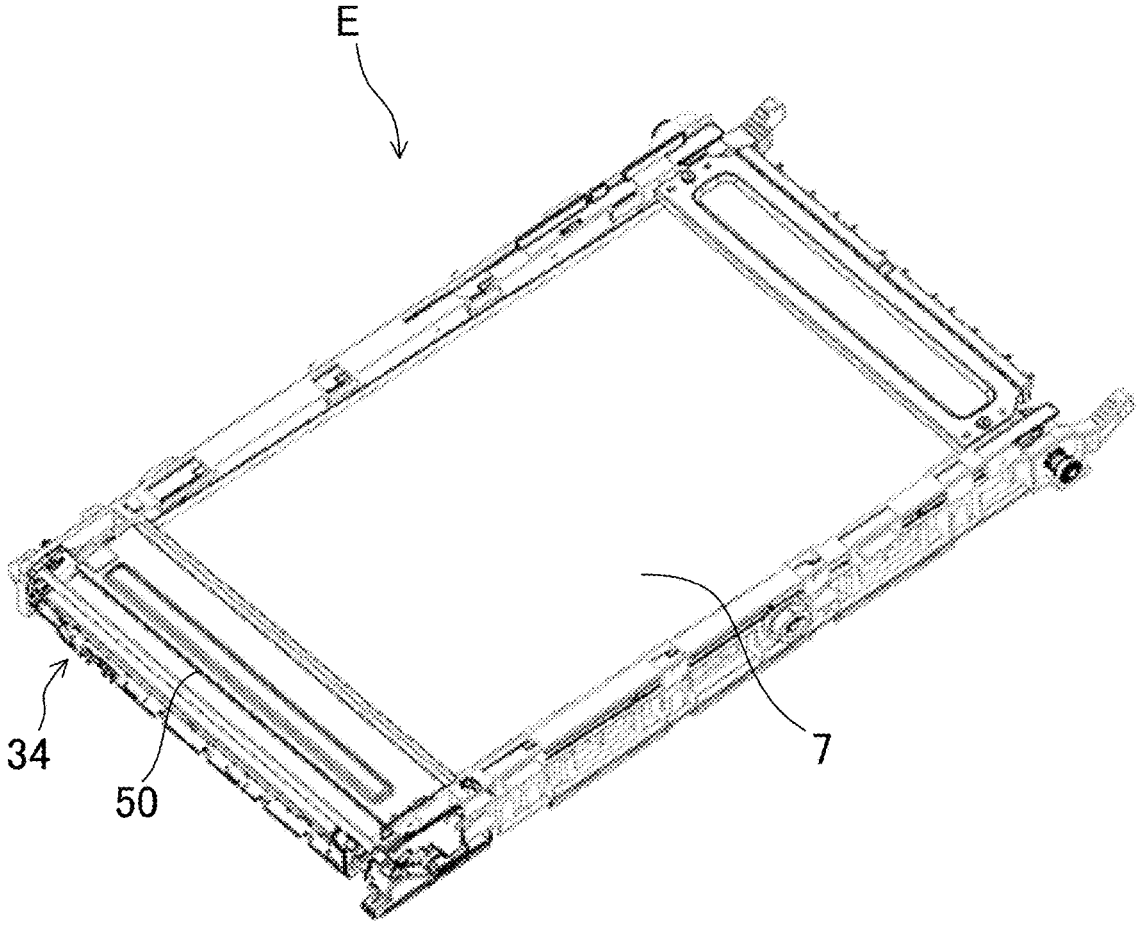
Fig.11 Prior Art
FIG. 11 is a view corresponding to FIG. 2, which illustrates the related art.
Figure 12:
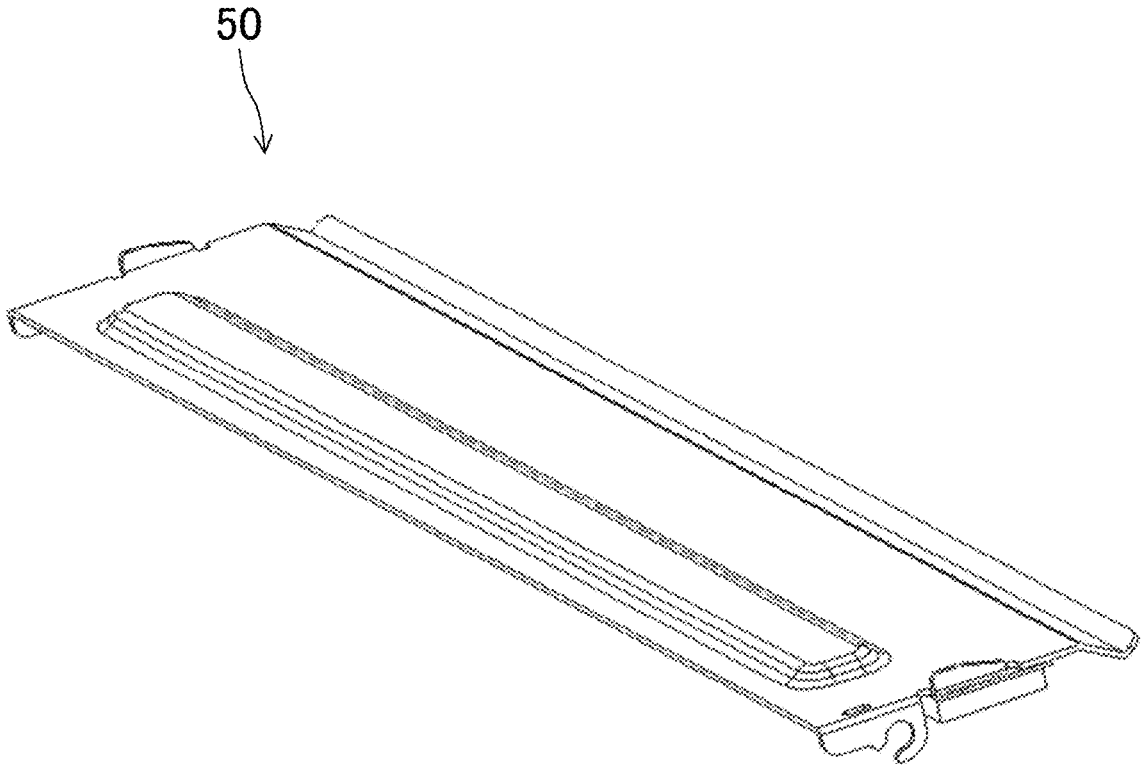
Fig.12 Prior Art
FIG. 12 is a view corresponding to FIG. 4, which illustrates the related art.
Figure 13:
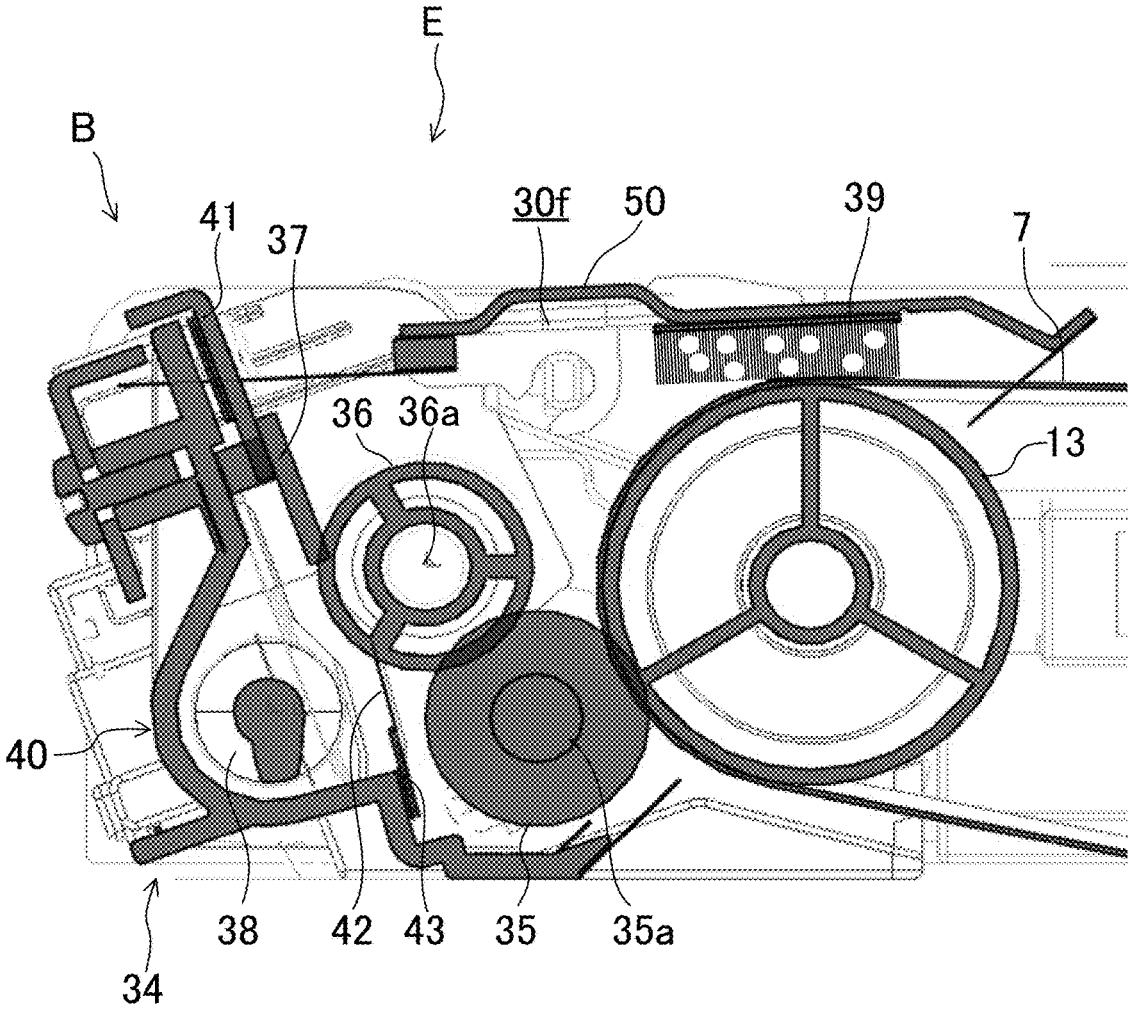
Fig.13 Prior Art
FIG. 13 is a view corresponding to FIG. 3A, which illustrates the related art.

As illustrated in FIG. 11 to FIG. 13, in an intermediate transfer unit E installed in a conventional image forming apparatus, since openings are not formed in a support member 50, foreign matters (see white circles of FIG. 13) are clogged and deposited between the brush fibers of the pre-cleaning brush 39. As a consequence, there is a problem that the physical function (a toner scratching function) of the pre-cleaning brush 39 becomes useless.

However, in the present embodiment, even though foreign matters such as toner and paper powder are clogged between the brush fibers of the pre-cleaning brush 39, the foreign matters (see white circles of FIG. 3A) are liberated upward from the openings 30*f*. Consequently, the foreign matters are less likely to be deposited between the brush fibers of the pre-cleaning brush 39. Thus, it is possible to suppress the toner scratching function of the pre-cleaning brush 39 from being reduced due to deposition of the foreign matters between the brush fibers.

<<Embodiment 2>>

Figure 6:
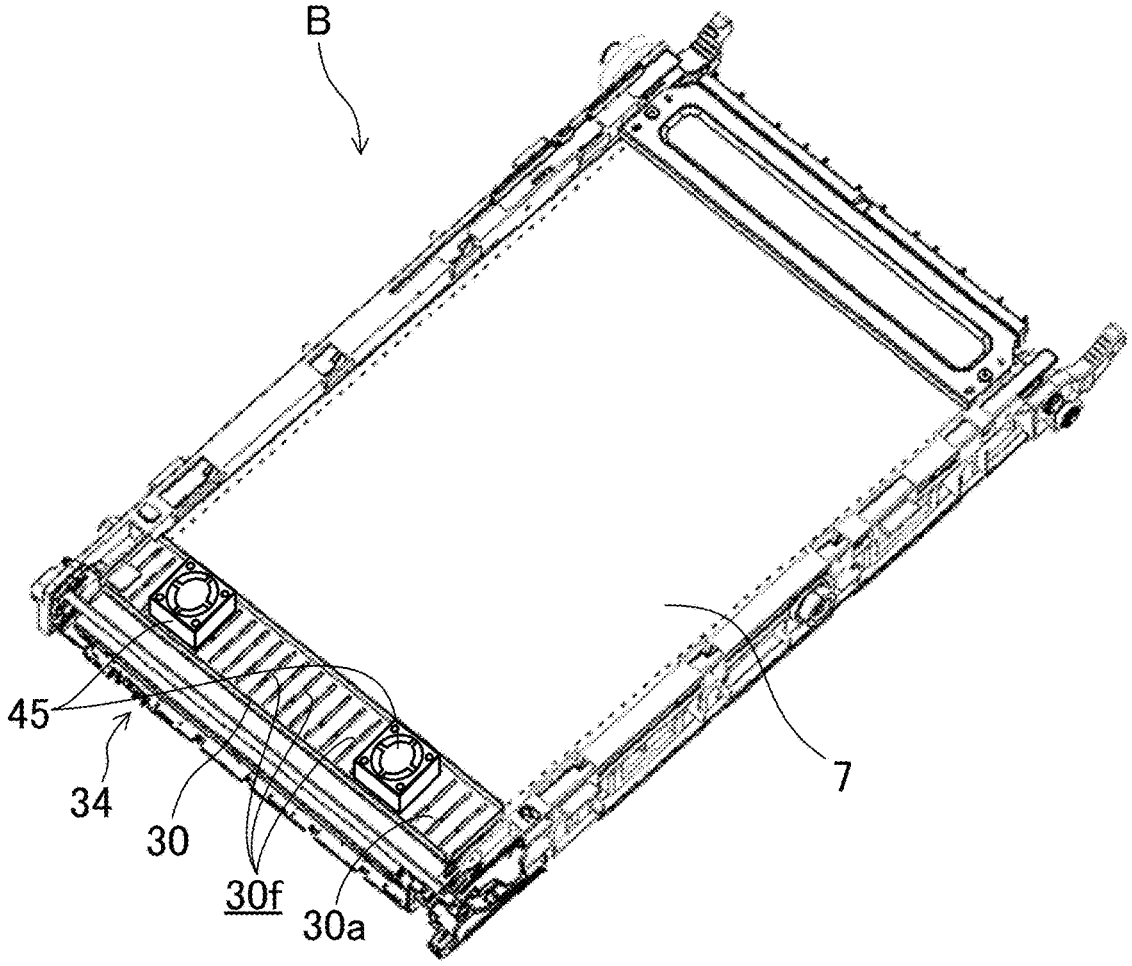
FIG. 6 is a view corresponding to FIG. 2, which illustrates an embodiment 2.
Figure 7:
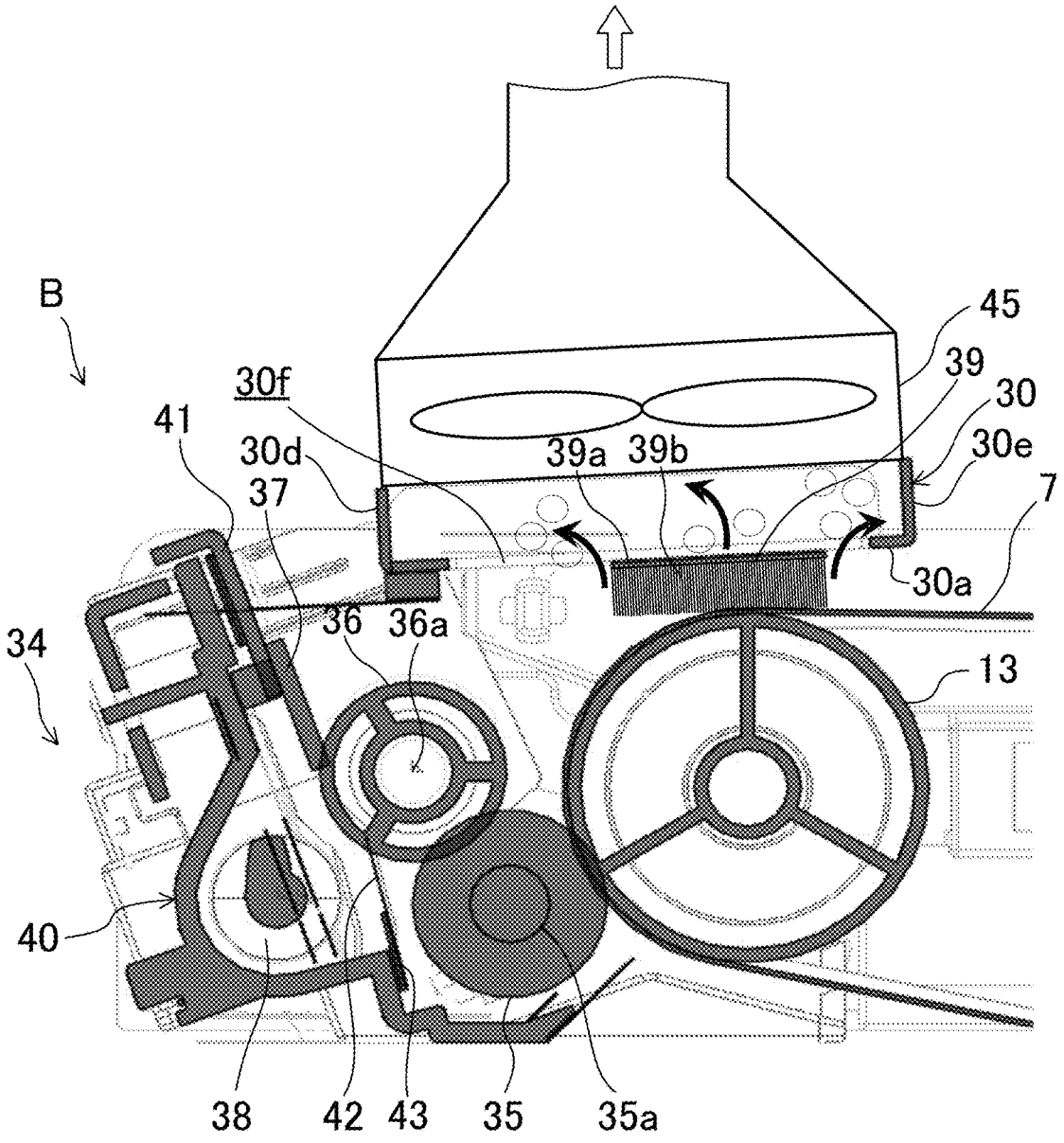
FIG. 7 is a view corresponding to FIG. 3A, which illustrates an embodiment 2.

FIG. 6 and FIG. 7 illustrate an embodiment 2. The present embodiment is different from the aforementioned embodiment 1 in that two suction fans 45 are provided at an upper side of the support member 30. In the following description, the same reference numerals are used to designate the same elements as those of the embodiment 1 and detailed description thereof will be omitted.

The two suction fans 45 are disposed symmetrically about a center position of the support member 30 in the longitudinal direction. Each of the suction fans 45 has a square shape in a plan view and is supported across the left sidewall 30*d* and the right sidewall 30*e* of the support member 30. The suction fan 45 sucks foreign matters between the brush fibers of the pre-cleaning brush 39 through each opening 30*f* of the support wall 30*a*. Consequently, it is possible to more reliably suppress foreign matters from being deposited between the brush fibers. Thus, it is possible to reliably obtain operations and effects similar to those of the embodiment 1.

<<Embodiment 3>>

Figure 8:
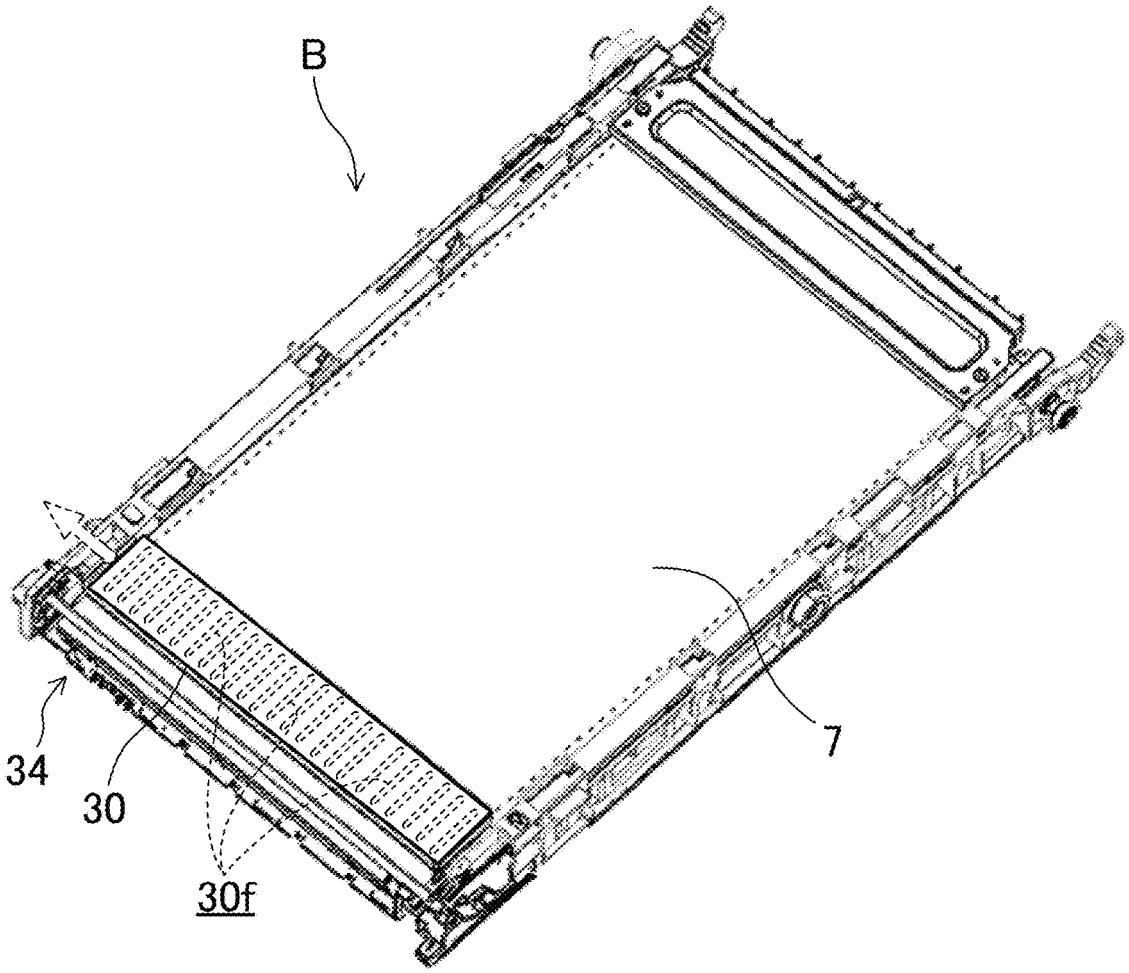
FIG. 8 is a view corresponding to FIG. 2, which illustrates an embodiment 3.
Figure 9:
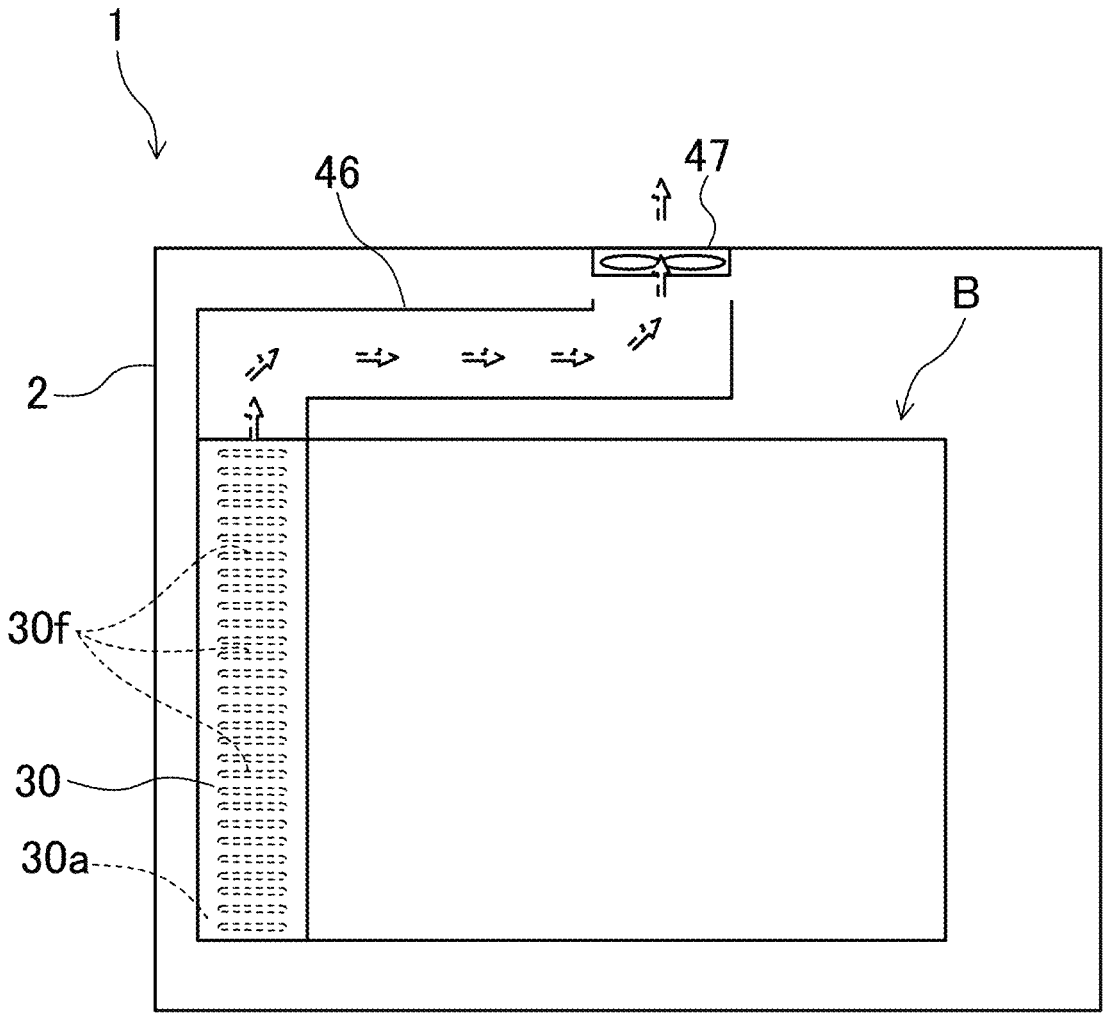
FIG. 9 is a schematic plan view when an image forming apparatus of an embodiment 3 is viewed from an upper side.

FIG. 8 and FIG. 9 illustrate an embodiment 3. The present embodiment is different from the embodiment 2 in terms of a shape of the support member 30 and an arrangement configuration of suction devices.

In the present embodiment, the support member 30 has a duct shape extending in a belt width direction along the transfer surface of the intermediate transfer belt 7. In the duct shape, only one side (a read side of the image forming apparatus 1) in the belt width direction is opened. A lower sidewall (a wall part facing the transfer surface of the intermediate transfer belt 7) of the support member 30 serves as a support wall 30*a*, wherein the support wall 30*a* is formed with a plurality of openings 30*f* arranged spaced apart from one another in the belt width direction, similarly to the embodiment 1.

As illustrated in FIG. 9, the opening of one side of the support member 30 in the belt width direction is connected to a duct 46. An end part of the duct 46, which is opposite to the support member 30 side, is positioned near a suction port of a suction fan 47. The suction fan 47 is mounted at a read sidewall of the image forming apparatus 1. The suction fan 47 is an existing fan for discharging foreign matters in a casing 2, which constitutes an outer wall of the image forming apparatus 1, out of the apparatus. In the present embodiment, the existing suction fan 47 is used as a suction device that sucks foreign matters from the pre-cleaning brush 39. Thus, it is possible to reduce cost as compared with a case where the suction fan 45 dedicated for the pre-cleaning brush 39 is provided as with the embodiment 2.

<<Embodiment 4>>

Figure 10:
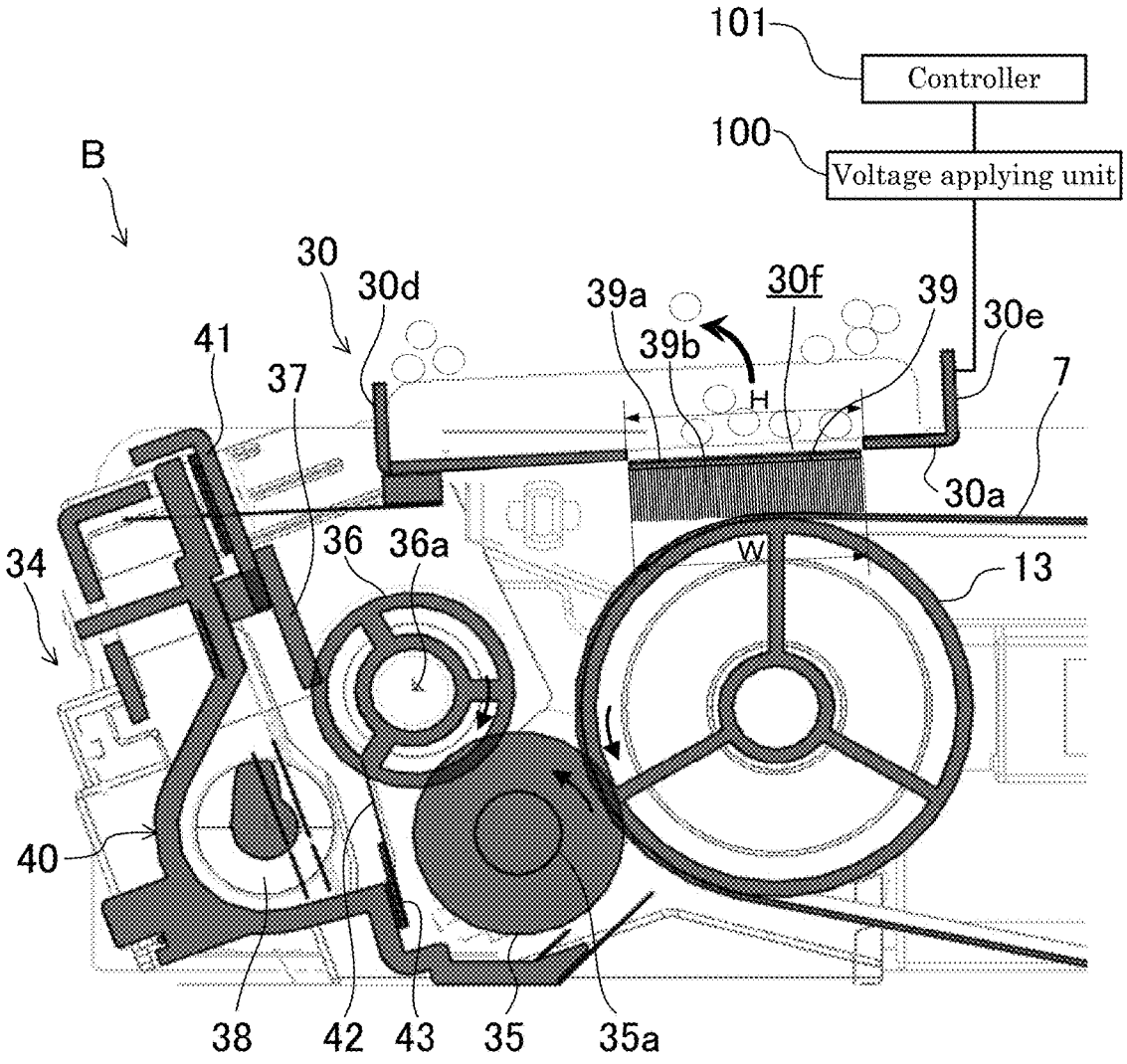
FIG. 10 is a view corresponding to FIG. 3A, which illustrates an embodiment 4.

FIG. 10 illustrates an embodiment 4. In the present embodiment, a dimension of the opening 30*f* of the support member 30 is different from the aforementioned each embodiment. That is, in the aforementioned each embodiment, the length H of the opening 30*f* is larger than the width W of the pre-cleaning brush 39; however, in the present embodiment, the length H of the opening 30*f* is set to be equal to the width of the pre-cleaning brush 39.

According to the configuration, foreign matters liberated upward (an opposite side of the intermediate transfer belt 7 side) through the opening 30*f* can be prevented from flowing back to the intermediate transfer belt 7 side through the opening 30*f*.

<<Other Embodiments>>

In the aforementioned embodiments, the controller 101 is configured to control the voltage applying unit 100 such that a voltage to be applied to the pre-cleaning brush 39 has a polarity (a plus polarity in the present embodiment) equal to a charging polarity of toner; embodiments are not limited thereto. That is, the controller 101 may allow a voltage polarity of a voltage to be applied by the voltage applying unit 100 to differ in a part corresponding to an image formation area in the intermediate transfer belt 7 and an inter-paper area. In this way, it is possible to improve recovery efficiency of foreign matters by the recovery roller 36.

Furthermore, the aforementioned embodiment 1 has described an example in which the plurality of through holes 39*c* are formed in the base 39*a*; however, the through holes 39*c* are not always necessary. Even though the through holes 39*c* are not formed, it is possible to liberate foreign matters upward from a part, which is not closed by the base 39*a*, of the opening 30*f* of the support member 30.

The technology of the present disclosure includes an arbitrary combination of the aforementioned embodiments. That is, for example, the length H of the opening 30*f* may be set to have the same size as the width W of the pre-cleaning brush 39 by combining the embodiment 2 with the configuration of the embodiment 4.

What is claimed is:

1. An image forming apparatus comprising:

an endless transfer belt that travels while carrying a toner image on a transfer surface thereof;

a cleaning device that sweeps off toner remaining on the transfer surface of the endless transfer belt by using a rotary brush, electrically adsorbs the toner swept by a recovery roller, and removes the toner;

a pre-cleaning brush that slidably contacts with the transfer surface of the endless transfer belt at an upstream side in a rotation direction of the endless transfer belt from the cleaning device, the pre-cleaning brush having conductivity;

a support member that supports the pre-cleaning brush from a side opposite to a side of the endless transfer belt, the support member having a support wall that extends over approximately a whole in a width direction of the endless transfer belt while facing the transfer surface of the endless transfer belt and supports the pre-cleaning brush, the support member having conductivity, and the support wall being formed with openings that liberate foreign matter including toner deposited onto the pre-cleaning brush;

a suction device that sucks the foreign matter deposited onto the pre-cleaning brush through the openings from a side of the support wall of the support member that is opposite to the side of the endless transfer belt;

a voltage applying unit that applies a voltage having a predetermined polarity to the pre-cleaning brush via the support member; and a control unit that controls a polarity of the voltage to be applied by the voltage applying unit, wherein the control unit is configured to allow the polarity of the voltage to be applied by the voltage applying unit to differ in a part corresponding to an image formation area in the endless transfer belt and an inter-paper area.

2. The image forming apparatus of claim 1, wherein the suction device is a suction fan for discharging foreign matter in a casing, which constitutes an outer wall of the image forming apparatus, to outside of the image forming apparatus.

3. The image forming apparatus of claim 1, wherein the openings include a plurality of long holes extending in the rotation direction of the endless transfer belt and arranged spaced apart from one another in the width direction of the endless transfer belt.

4. The image forming apparatus of claim 1, wherein the support member has a duct shape extending in the width direction of the endless transfer belt along the transfer surface of the endless transfer belt, and a wall part of the support member, which faces the transfer surface of the endless transfer belt, serves as the support wall.

* * * * *